United States Patent [19]

Martin

[11] Patent Number: 4,658,449

[45] Date of Patent: Apr. 21, 1987

[54] PROCTECTIVE ADAPTER FOR POOL DRAIN

[76] Inventor: Daniel R. Martin, 809 E. Gloria Switch Rd., Lafayette, La. 70507

[21] Appl. No.: 777,748

[22] Filed: Sep. 19, 1985

[51] Int. Cl.[4] ..... E04H 3/18

[52] U.S. Cl. ..... 4/496; 4/286; 4/288; 4/292; 4/504; 210/163; 210/166; 210/162; 210/497.3

[58] Field of Search ..... 7/496, 504, 286, 287, 7/288, 290, 289, 292, 290; 210/166, 499, 497.3, 497.01, 162, 163, 169

[56] References Cited

U.S. PATENT DOCUMENTS

| | | | |
|---|---|---|---|
| 345,318 | 7/1886 | Poor | 210/497.3 X |
| 3,245,540 | 4/1966 | Johnson | 210/497.3 X |
| 3,378,858 | 4/1968 | Jacuzzi | 4/507 X |
| 3,517,813 | 6/1970 | Thaler | 210/166 |
| 3,731,815 | 5/1973 | Collingwood et al. | 210/499 X |
| 3,742,524 | 7/1973 | Ballentine | 4/286 |
| 4,170,047 | 10/1979 | Corsette et al. | 4/286 X |
| 4,207,631 | 6/1980 | Baggey | 4/286 |
| 4,471,497 | 9/1984 | Riutort et al. | 4/286 |
| 4,505,814 | 3/1985 | Marshall | 210/166 |
| 4,525,273 | 6/1985 | Logsdon | 210/164 |

*Primary Examiner*—Henry K. Artis

*Attorney, Agent, or Firm*—Pravel, Gambrell, Hewitt & Kimball

[57] ABSTRACT

An adapter for pool drains, including a primary mounting frame secured onto the pool drain with a plurality of arms radiating inwardly and raised to interconnect the second mounting ring. There is further provided a grill work or second secured to the surface of the apparatus for defining a raised screening surface for screening any water flowing into the drain to prevent whirlpooling effect in the drain. Further, the apparatus is adapted for various size drains and is easily removable and set in place.

6 Claims, 3 Drawing Figures

PROCTECTIVE ADAPTER FOR POOL DRAIN

FIELD OF THE INVENTION

The apparatus of the present invention relates to pool drains. More particularly, the present invention relates to an apparatus adaptable atop a swimming pool drain, jacuzzi drain or hot tub drain, which would eliminate the possibility of injury or drowning of children due to the suction of the drain while the pool is being drained.

BACKGROUND OF THE INVENTION

In the art of swimming pools and the method of draining, the most common type of drain is a central drain hole on the bottom portion of the pool which would be similar to a drain in a laboratory or the like, wherein when the drain is open the weight of the water in the pool plus the suction from the pump would force the water through the drain and out to be drained. Due to the enormous amount of water that is present in a pool or even a large hot tub and suction from the pump, the force of the water going down the drain would normally create a suction or even a whirlpool effect, and anyone, in particular, a child swimming in the vicinity may literally be pulled to the bottom of the pool and unable to escape the suction of the drain. This, of course, would lead in the worse case to be drowning of the person if he or she is unable to free themselves from the force of the water.

Due to the various sizes, widths, and shapes of the various types of pool drains, it would be beneficial in the art to have a universal bracket which would be adaptable to the various size pool drains, and would yet serve to eliminate the problem of the suction created by the drain due to the whirlpool effect, and therefore eliminate the possibility of injury or death to a person.

SUMMARY OF THE PRESENT INVENTION

The apparatus of the present invention solves the shortcomings in the art in a straight forward manner. What is provided is an adaptable pool drain apparatus, which would generally include a bracket frame mountable along the floor of the pool, generally across the width of the drain for securing the apparatus in position above the drain hole. There would be further included an outer frame bottom mounted onto the bracket for securing the apparatus along the bottom face of the pool. In the preferred embodiment, the apparatus would further include a plurality of radiating arms radiating inward from the circular frame to a raised central portion where there would be further included a top frame ring with the radiating arms extending therebetween. In the preferred embodiment, there would be further included a grill work such as screen or connecting bars interconnecting the various radiating arms to define an overall circular raised grill mounted atop the pool drain, so that any water flowing into the drain would be prevented from forming the whirlpool effect, and would be properly distributed over the grill work for preventing suction occuring at that point. In the preferred embodiment, the drain would be easily removable and would come in various shapes and sizes.

Therefore, it is an object of the present invention to provide an apparatus for mounting onto a pool drain to prevent suction at the drain hole that could trap someone onto it;

It is a further object of the present invention to provide an apparatus so constructed so that the portion above the drain hole is raised from the drain hole, and prevents a direct flow of water into the drain hole with use of the apparatus;

It is still a further object of the present invention to provide an apparatus having a means for breaking up any whirlpool effect of draining water that might be flowing down the drain while draining of the pool.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
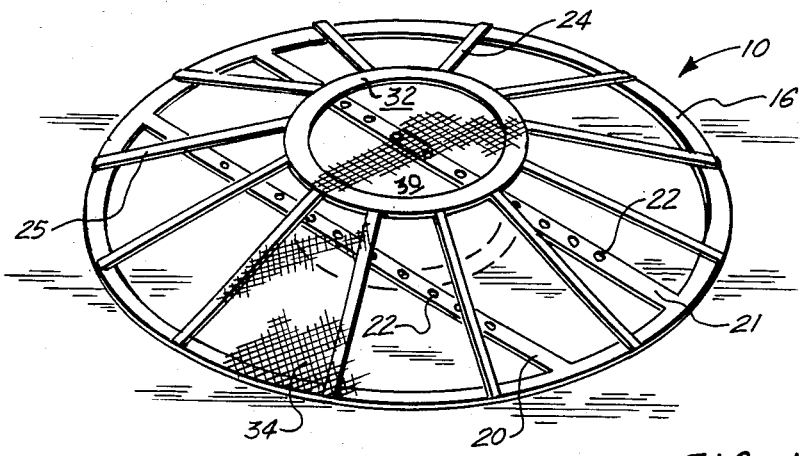
FIG. 1, is an overall prospective view of the preferred embodiment of the apparatus of the present invention mounted on a pool drain.
Figure 2:
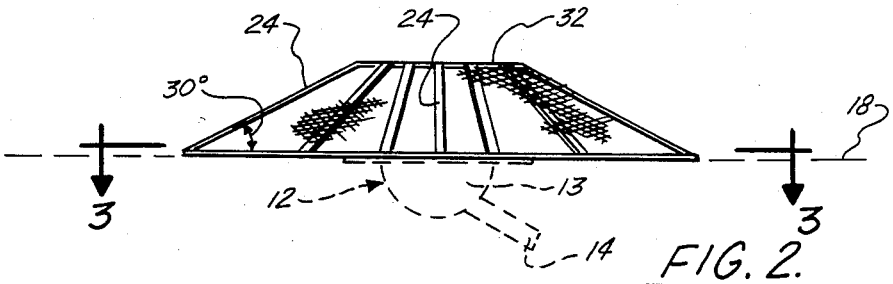
FIG. 2, is a side view of the preferred embodiment of the apparatus of the present invention mounted on a pool drain.
Figure 3:
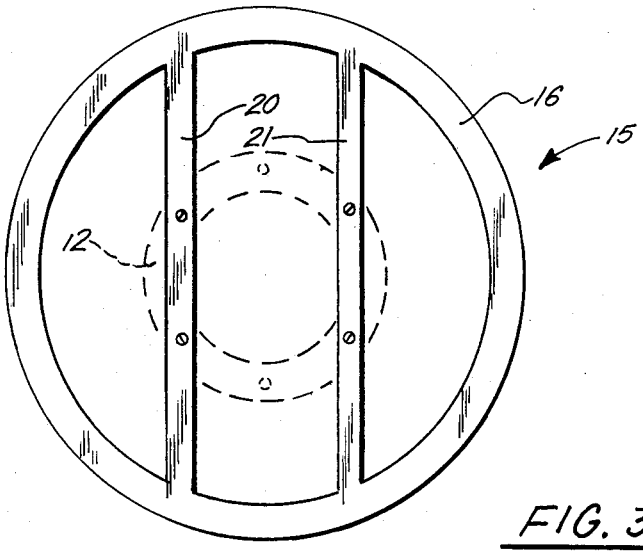
FIG. 3, is a top view of the bottom frame of the preferred embodiment of the apparatus of the present invention taken along lines 3—3 of FIG. 2.

The preferred embodiment of the apparatus of the present invention is illustrated in the FIGS. 1 through 3 by the numeral 10. In the preferred embodiment, drain adapter 10 would be mounted upon a pool drain 12, as seen in the FIGURES, which is generally a grilled 6 to 8 inch hole on the bottom of the pool having a recessed area 13 with a drain line 14 for draining off water in the pool or hot tub. In the preferred embodiment, as seen particularly in FIG. 3, drain adapter 10 would first comprise an outer lower perimeter frame 16 which for the most part would be of much larger diameter than the pool drain 12, and would be set flush against the floor 18 of a swimming pool or hot tub.

As seen in FIG. 3, perimeter frame 16 would include a pair of intersecting parallel mounting arms 20 and 21 which also lie flush against the pool surface 18 but would intersect across pool drain 12 and would be provided with a plurality of bolt or screw holes 22 along the length of mounting arms 20 and 21 for boltingly securing frame 15 onto the pool drain 12. As seen in the drawings, perimeter frame 16 is of a much greater circumference than pool drain 12, due to the fact that this would enable frame 15 to be mounted onto various size pool drains, with the bolts being secured through the appropriate holes 22 as dictated by the circumference of the pool drain 12 frame. Apparatus 10, further comprises, as particularly seen in FIGS. 1 and 2, a plurality of radiating arms 24 which are secured at their first end 25 to perimeter frame 16 via welding or the like, and radiate inwardly and at an angle approximately 30 degrees from the horizontal to converge at a point above the cental portion 30 of apparatus 10 wherein they are secured to a second smaller mounting ring 32, the radiating arms and mounting ring 32 defining a raised inclined surface means above mounting frame 15 and pool drain 12. In the preferred embodiment as seen in the FIGURES, apparatus 10 further includes a means for distributing the water flow into drain 12 over a larger area, this means would comprise in the preferred embodiment: a metal or metallic (or hard plastic) grill work 34 secured to and completely covering the raised area as defined by radiating arms 24 and upper mounting ring 32. Grill work 34 could be of the type of metallic heavy metallic mesh or could be a plurality of metal arms interconnecting the radiating arms and interconnecting the central portion across mounting ring 32 for defining a rasied filter or trap for preventing water that would normally swirl into drain 12 from creating the swirling and consequential suction effect, and would tend to spread the flow of the water into drain 12 over the surface of apparatus 10, therefore, to minimize or completely eliminate any suction effect that would occur. Likewise, even if suction may occur, the suction would occur over the broadened surface area of apparatus 10 too large an area to be stopped by a human body, and would therefore be of less effect and would in all likelihood be so minimal so anyone who would move toward in the area of the drain could easily dislodge themselve, even the smallest child.

As was discussed earlier, due to the configuration of the intersecting parallel mounting arms 20 and 21 and the plurality of mounting holes along the length of arms 20 and 21, the adapter is able to accomodate a variety of pool drain, size and shapes, and can be easily placed on or removed from the pool drain. Also, in other embodiment, the apparatus may be of rectangular or various shapes to fit even a particular type of confected drain.

The foregoing description of the invention is illustrative and explanatory thereof, and various changes in the size, shape and materials, as well as in the details of the illustrated construction may be made without departing from the spirit of the invention.

What is claimed as invention is:

1. An apparatus adaptable onto the drain of a pool for disturbing the water prior to the water entering the pool drain, comprising:

a. a primary frame member positioned flush against the pool floor, and having a pair of mounting arms secured to the pool drain;

b. a second upper frame member raised above the primary frame member, said second upper frame member and primary frame member being of sufficient width to at least cover the broadest opening of the pool drain;

c. a plurality of radiating arms rigidly interconnecting the primary frame member and the upper frame member said radiating arms defining a raised surface above the pool drain; and d. means interconnecting the radiating arms and the upper frame member for defining a continuous screen substantially above the pool drain so that water entering the pool drain must first enter the screen in its flow.

2. The apparatus in claim 1, wherein the pair of mounting arms further comprise means for attaching to various size and shapes of pool drains.

3. The apparatus in claim 2, wherein the means interconnecting the radiating arms in the upper frame further comprises wire mesh or grill work.

4. The apparatus in claim 3, wherein the perimeter frame is of much greater diameter than the pool drain, and the upper frame is substantially of equal diameter to the pool drain located approximately 3 to 4 inches above the pool drain.

5. The apparatus in claim 4, wherein the radiating arms radiate inward from the primary frame at an angle of approximately 30 degrees above the horizontal.

6. An adapter for pool drains, comprising:

a. a substantially circular perimeter frame mounted on the pool surface and of much greater diameter than the pool drain;

b. a pair of parallel arm members extending within the perimeter frame for rigidly securing the frame to the pool drain;

c. a plurality of radiating arms extending inwardly from the primary frame at an angle approximately 30 degrees above the horizontal and converging substantially to the center of the primary frame;

d. a mounting ring secured to the end portions of the radiating arms, for defining a drain surface substantially 3 to 4 inches above th pool drain; and e. grill means substantially covering the surface area defined by the radiating arms and mounting ring, for screening any flow of water into the pool drain at a point above the pool drain to disturb the flow and prevent a whirlpooling effect into the drain.

* * * * *